US005572890A

United States Patent [19]

Carpenter

[11] Patent Number: 5,572,890

[45] Date of Patent: Nov. 12, 1996

[54] HIGH SECURITY LOCK SYSTEM INCLUDING COVER PLATE

[75] Inventor: Larry L. Carpenter, Olympia Fields, Ill.

[73] Assignee: American Lock Company, Crete, Ill.

[21] Appl. No.: 324,282

[22] Filed: Oct. 14, 1994

[51] Int. Cl.[6] ..... E05B 9/04; E05B 67/22

[52] U.S. Cl. ..... 70/371; 70/417; 70/52; 70/38 A

[58] Field of Search ..... 70/398, 52, 417, 70/371, 38 A, 38 B, 38 C, 51, 423, 455, 450, 451, 454

[56] References Cited

U.S. PATENT DOCUMENTS

| | | | |
|---|---|---|---|
| 3,422,643 | 1/1969 | Foote | 70/371 |
| 3,835,676 | 9/1974 | Foote | 70/417 |
| 4,241,594 | 12/1980 | Miller et al. | 70/52 |
| 4,290,279 | 9/1981 | Fish et al. | 70/52 |
| 4,419,873 | 12/1983 | Sopko | 70/52 |
| 5,211,044 | 5/1993 | Kim | 70/390 |

*Primary Examiner*—Darnell M. Boucher
*Attorney, Agent, or Firm*—McDermott, Will & Emery

[57] ABSTRACT

A high security lock includes a lock housing, lock cylinder and a lock core. The lock housing defines a key receiving surface and a cavity for receiving the lock cylinder. A cover plate is attached to the lock housing and is located between the lock cylinder and the key receiving surface. The cover plate covers a portion of the lock core. A retaining shield is received in the cavity, which engages the cover plate and is attached within the cylinder.

12 Claims, 3 Drawing Sheets

HIGH SECURITY LOCK SYSTEM INCLUDING COVER PLATE

BACKGROUND OF THE INVENTION

1. Field of the Invention

This invention relates to a lock construction providing improved security features. More particularly, this invention relates to a lock assembly having a decreased vulnerability to intrusive physical attack.

2. Background of the Invention

Because the security of conventional locks and padlocks can be violated in many different ways, it is often desirable to afford increased security in such mechanisms. A conventional lock cylinder assembly is known to include a security harness of sturdy construction that is designed to enshroud the exterior of the lock mechanism to protect the interchangeable core from destructive physical attack.

Other security features are aimed at protecting the lock core from attack. In particular, improved security features are taught in U.S. Pat. No. 4,918,950 to Foshee; U.S. Pat. No. 4,180,996 to Lebrecht; and U.S. Pat. No. 4,949,564 to Barzilai. Foshee teaches a complicated cylinder cap and keyway-disc mechanism to protect the lock core from attack. To protect the lock core, the device disclosed in the Foshee patent requires many parts, as well as a complicated assembly procedure, which causes the lock's manufacturing costs to be high. Another disadvantage of the device disclosed in the Foshee patent is the complexity of the cap which protects the lock core. Furthermore, the device of the Foshee patent is inaccessible when the padlock is in its locked position.

Lebrecht teaches a device which protects against a potential thief sawing through a padlock's protective casing by implanting freely rotatable hardened pins within the padlock shrouding which spin when attacked by a saw blade. However, the device disclosed in the Lebrecht patent has the disadvantage of not protecting the front face of the interchangeable lock core from attack by an intruder. The lock core disclosed in the Lebrecht patent is readily accessible by a conventional pulling tool.

Barzilai teaches a lock core cover which slidably fits within the end of a tubular padlock. However, the cover shown in the Barzilai patent is vulnerable to attack. The Barzilai cover is held in place by a relatively weak and expensive-to-manufacture snap-action fastener pin.

Thus, a need exists for a simple, inexpensive device to protect a padlock's lock core from attack by would-be thieves. In particular, a need exists for a padlock which protects the padlock core from being pulled from the padlock shroud by means of a "slam-puller," "nose-puller" or other lock attacking tool. Such tools are used to attack the relatively soft padlock core, and thereby, to breach the security of the padlock. A further need exists to accomplish this feature using a simple construction having few parts.

In summary, known means of increasing the security of lock mechanisms have the disadvantage of increasing the overall complexity of the mechanism and increasing manufacturing costs and the number of parts necessary to achieve increased security. A substantial need exists for an efficiently designed, economical, high security lock system.

SUMMARY OF THE INVENTION

According to the present invention, a high security lock apparatus includes a lock cylinder, having a lock core and a lock housing with a key receiving surface and a cavity for receiving the lock cylinder. Further, the lock apparatus includes a cover plate removably attached to the lock housing. The cover plate is located between the lock cylinder and the key receiving surface of the lock housing and covers a portion of the lock core. A retaining shield is also received in the lock housing cavity and is attached to the lock housing. The retaining shield engages the cover plate to hold it in place.

An object of the present invention is to inhibit a breach of the core of the padlock by shielding the core from pulling tools, drills, or other tools designed to attack lock mechanisms.

Another object of the present invention is to reduce the number of parts necessary to achieve lock core protection.

Still another object of the present invention is to reduce the number of production stages necessary to manufacture a lock.

Another object of the present invention is reducing the cost to manufacture a lock.

Yet another object of the invention is to provide a retaining shield which retains a cover plate in a fixed location.

Another object of the present invention is to secure a cover plate retaining shield to a lock housing by a means which is inaccessible to a potential thief when the padlock is in the locked position.

Another object of the present invention is to prevent rotation of a padlock key more than 90 degrees.

Another object of the present invention is to provide a cover plate which is encased entirely in the lock housing.

Additional objects, features, and advantages of the invention will become apparent to those skilled in the art upon consideration of the following detailed description of the invention. The objects and advantages of the present invention may be realized and attained by means of the instrumentalities and combinations particularly pointed out in the appended claims.

BRIEF DESCRIPTION OF THE DRAWINGS

These and other features of the invention will now be described with reference to the drawings of a preferred embodiment which is intended to illustrate and not to limit the invention. In the accompanying drawings which form a part of the specification, the numerals and letters refer to terms and elements of the invention discussed below in the detailed description of the invention.

DETAILED DESCRIPTION OF THE INVENTION

Figure 1:
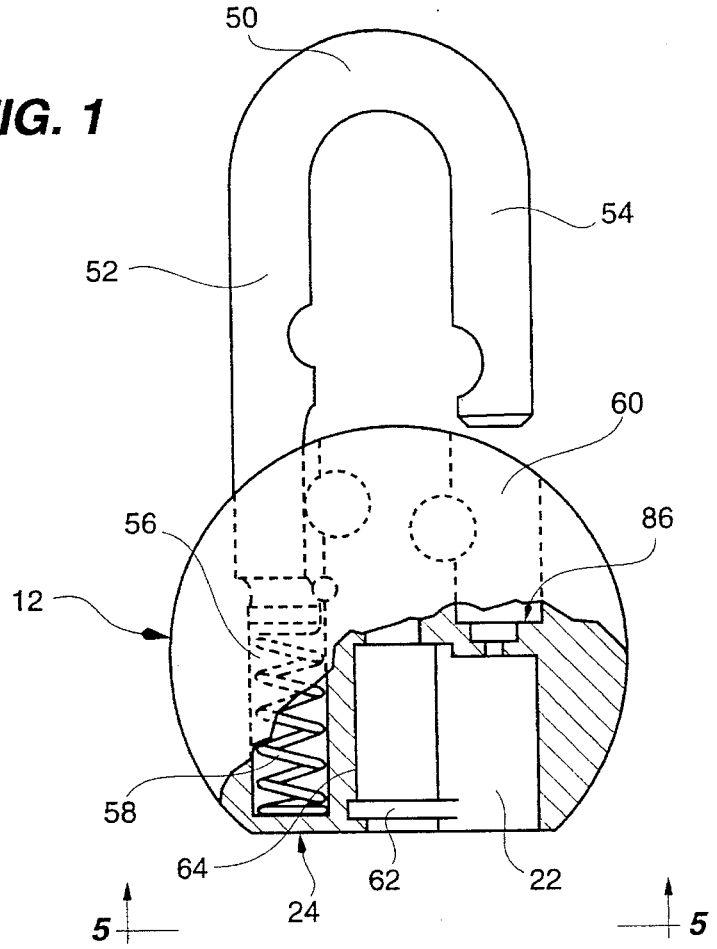
FIG. 1 is a partial cutaway front view of a lock housing of the present invention in an unlocked condition.
Figure 2:
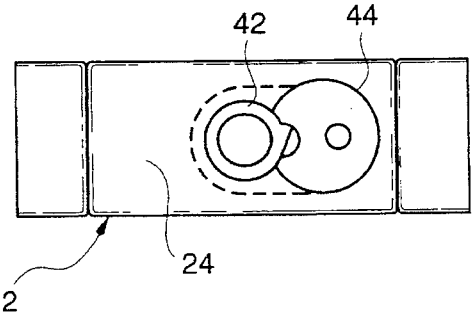
FIG. 2 is a bottom view of the lock housing of FIG. 1 taken generally along line 2—2 of FIG. 1.
Figure 3:
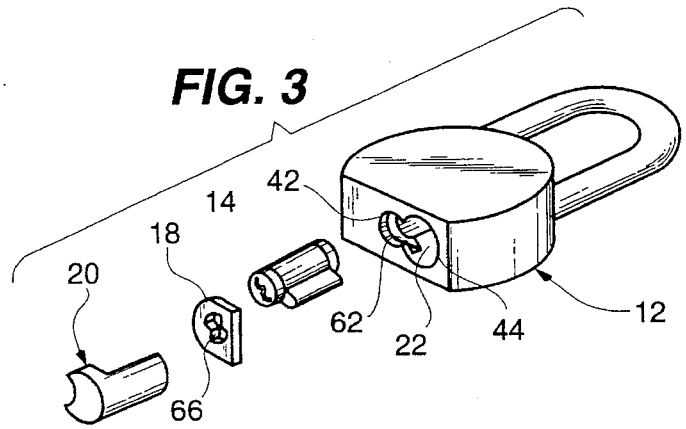
FIG. 3 is a partial exploded view of the lock housing of FIG. 1.
Figure 4:
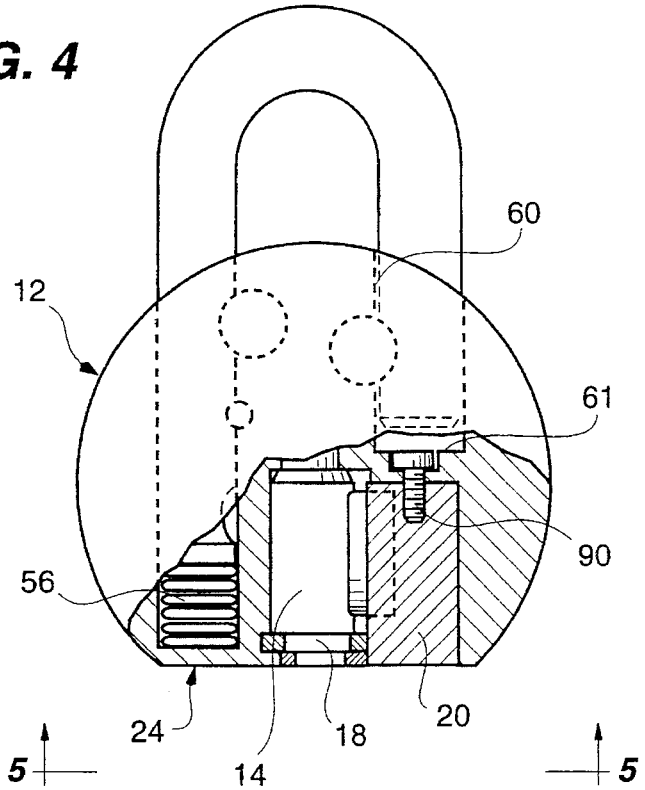
FIG. 4 is a partial cutaway front view of a lock housing of the present invention in a locked condition.
Figure 10:
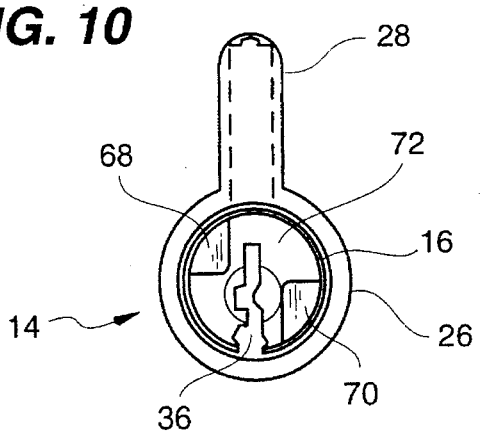
FIG. 10 is a front view of a lock cylinder, interchangeable lock core and cover plate prongs of the present invention.

A lock in accordance with the present invention is shown in FIGS. 1–5, and comprises a lock housing 12 defining a cavity 22. Cavity 22 receives a lock cylinder 14, a cover plate 18 and a retaining shield 20. As shown in FIG. 10, lock cylinder 14 includes an interchangeable lock core 16. The lock of the present invention can be used in any application calling for a cylinder lock. As shown in FIGS. 3 and 4, the cylinder 14 is mounted in the cavity 22 and is protected by the cover plate 18 which is located between the cylinder 14 and the key receiving face 24 of the lock housing 12. As is well known to those skilled in the art, the lock cylinder 14 may be interchangeable.

The lock housing 12 may be of various shapes and sizes. In the lock shown in the present drawings the lock housing 12 is made of solid steel from which a cavity 22 is formed. As in padlocks known to those skilled in the art, the lock may include a shackle such as a U-shaped shackle 50 having a first shackle leg 52 and a second shackle leg 54. The present invention also includes other shackle mechanisms known to those skilled in the art. The first shackle leg 52 is engaged in the first shackle bore 56 which contains a shackle spring 58. Shackle spring 58 exerts force on the first shackle leg 52 to assist in the disengagement of the shackle 50. As shown in FIG. 4, when shackle 50 is in a locked position, the second shackle leg 54 rests within the second shackle bore 60. The lock housing 12 also has formed therein first and second shackle bores 56 and 60, respectively for receiving the padlock shackle legs 52 and 54. The first shackle bore 56 traverses across a majority of the lock housing 12. The second shackle bore traverses approximately one-half of the lock housing 12.

A front view of the lock cylinder 14 and interchangeable lock core 16 is shown in FIG. 10. The lock cylinder 14 and interchangeable lock core 16 of the present invention are typical mechanisms known to those skilled in the art. The interchangeable lock core 16 is received by lock cylinder 14. It is within the scope of the present invention to use a different cylinder having other configurations. The lock cylinder 14 has a first lobe 26 which receives the interchangeable lock core 16, and may have a second lobe 28 which contains pin tumblers (not shown). The interchangeable lock core 16 is formed with a keyway 36 therein and is rotatably mounted within the cylinder 14. As is known in the art, when the cylinder 14 is received by the cavity 22, the interchangeable lock core 16 engages with a lock-actuating cam (not shown). In this way rotation of the interchangeable lock core 16 is transmitted to a lock mechanism to unlock the lock. An advantage of the present invention is that the cylinder 14 is entirely encased by the lock housing 12 which is formed from solid steel and protected by a cover plate 18, and thus difficult to attack from any direction.

As shown in FIGS. 1 and 2, the cylinder 14 is received by cavity 22. The cavity 22 intersects the key receiving surface 24 of the lock housing 12 forming two intersecting cavity openings 42 and 44. The first cavity opening 42 is centrally located on the key receiving surface 24 of the lock housing 12 and the second cavity opening 44 is located on the key receiving surface 24 of the lock housing 12 generally below the second shackle bore 60. The drawings depict the cavity openings as being generally circular, however, the present invention does not limit the shape of the cavity. Other shapes may be implemented as well without affecting the functionality of the invention.

A cover plate receiving recess 62 is formed in the cavity wall 64 is located between the cylinder 14 and the key receiving surface 24 of the lock housing 12, and is preferably located approximately three sixteenths of an inch from the key receiving surface 24 of the lock housing 12. The present invention, however, does not limit the cover plate receiving recess 62 to being located at that depth. The cover plate receiving recess 62 is preferably one quarter of an inch in depth, although other depths may also be employed.

As shown in FIG. 3, the size and shape of the opening 44 is designed to generally coincide with the shape of the cover plate 18 so that the cover plate may be first received in the opening 44 and then slid into the cover plate receiving recess 62. FIG. 4 shows the cover plate 18 received by the cover plate receiving recess 62 between the key receiving surface 24 of the lock housing 12 and the cylinder 14. The cover plate 18 may be made of any difficult-to-attack material, including heat-treated or otherwise hardened steel or other similar materials well known to those skilled in the art.

Figure 5:
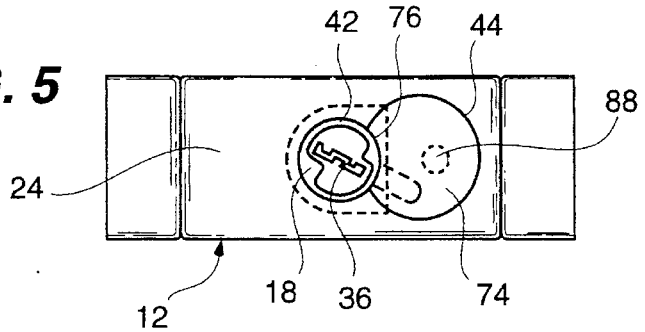
FIG. 5 is a bottom view of the lock housing of FIG. 4 taken generally along line 5—5 of FIG. 4.
Figure 6:
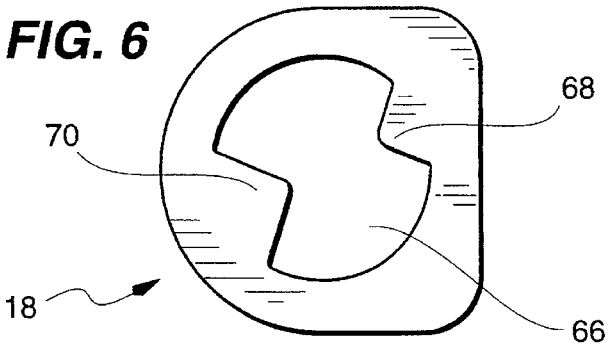
FIG. 6 is a front view of the cover plate of the present invention.

As is shown in FIG. 6, the cover plate 18 has a cover plate opening 66 through which the operating key of the lock passes. Opening 66 may be of varying shapes, but preferably has the shape shown in FIG. 6. Cover plate prongs 68 and 70 extend into the cover plate opening 66 and are profiled to limit the amount of rotation of a key inserted in lock core 16 to approximately 90 degrees. When the cover plate 18 rests within the cover plate receiving recess 62, the cover plate prongs 68 and 70 cover a portion of the front face of the core 72 as is shown in FIGS. 5 and 10. The cover plate prongs 68 and 70, however, do not block a key's access to the keyway 36. The cover plate prongs 68 and 70 may be of any shape that overlaps a portion of the interchangeable core 16 and which allows a key to be inserted in the keyway 36, and to be turned by a user of the lock.

Figure 7:
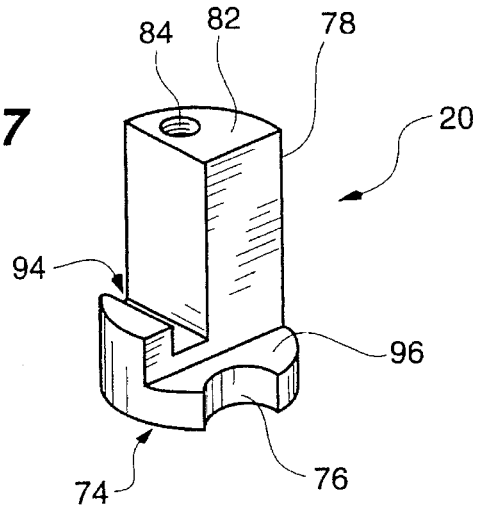
FIG. 7 is a perspective view of a retaining shield of the present invention.
Figure 8:
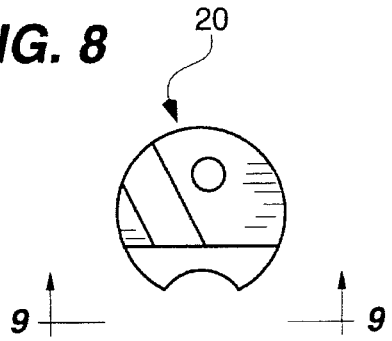
FIG. 8 is a top view of the retaining shield of FIG. 7.
Figure 9:
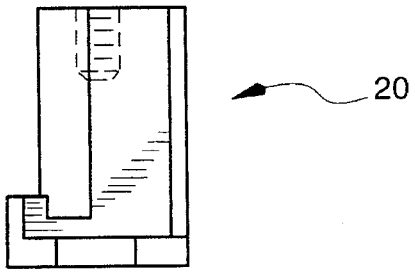
FIG. 9 is a front view of a retaining shield of FIG. 8 taken generally along line 9—9 of FIG. 8.

Retaining shield 20 is shown in detail in FIGS. 7–9. Retaining shield 20 is preferably made of heat-treated or otherwise hardened steel or other difficult-to-attack material. The retaining shield 20 includes a generally round shield cover 74 and post 78. The post 78 is contoured to fit within the second cavity opening 44. The shield cover 74 extends beyond the post 78 and is contoured to form a shield recess 76 and an inner surface 96. When the retaining shield 20 is received by the second cavity opening 44, the shield cover 74 is preferably flush with the key receiving surface 24 of the lock housing 12. Further, when the retaining shield 20 is received by the second cavity opening 44 and the cover plate 18 is received by the cover plate receiving recess 62, the retaining shield 20 obstructs the cover plate 18, which is thereby retained in the cover plate receiving recess 62.

As shown in FIG. 5, the shield recess 76 is aligned contiguous with the first cavity opening 42. The inner surface 96 is flush with the cover plate 18, when received in the second cavity opening 44. A groove 94 may be cut in the post 78, as is shown in FIG. 7, perpendicular to the shield cover 74. The groove 94 mates with the second lobe of the cylinder 14 when the retaining shield 20 is inserted in the second cavity opening 44. The width of the groove 94 is such that the second lobe of the cylinder 14 fits within the groove 94 so that the cylinder 14 is retained in one position when the interchangeable core 16 is rotated.

As shown in FIG. 9, the post end 82 includes a threaded retaining hole 84, which is aligned with a similarly sized clearance hole 88, which is located at the interior face 61 of the second shackle bore 60, as shown in FIG. 1. A retaining screw 90 is received by the threaded retaining hole 84 and the clearance hole 88, respectively, and holds in place the retaining shield 20, as shown in FIG. 4. When the lock is in the locked position, the second shackle leg 54 blocks access to the retaining screw 90. The present invention may also include other known means to retain the retaining shield in a fixed position. The retaining screw 90 may not be removed unless the lock is in the open position.

Assembly of the parts shown in FIG. 3 is accomplished by first inserting the cylinder 14 containing the interchangeable core 16 into the first cavity opening 42 to cause the interchangeable lock core 16 to mate with a lock actuating cam (not shown). Next, the cover plate 18 is inserted into the second cavity opening 44 and then slid into the cover plate receiving recess 62 so as not to obstruct access to the cavity 22 through the second cavity opening 44. Then, the retaining shield 20 is inserted into the second cavity opening 44 so that the shield cover 74 is flush with the key receiving surface 24 of the lock housing 12. Finally, the retaining screw 90 is screwed in the threaded retaining hole 84 through the clearance hole 88 and tightened to retain the retaining shield 20 in a fixed position.

One advantage of the present invention is that it provides a security shield, i.e., cover plate 18, that is sheltered in the interior of the lock housing 12. Another advantage of the present invention is that the retaining shield 20 acts as both to retain the cover plate 18 and cylinder 14 in a secure position and also to protect the second lobe 28 of the cylinder 14 from attack. Both the cover plate 18 and the retaining shield 20 protect the core from being pulled from a padlock by means of a "nose-puller" or other lock attacking tool. Moreover, these advantages are accomplished using minimal parts and at minimal manufacturing expense.

Still another advantage of the present invention's simple construction is the ease of replacing the interchangeable lock core 16 by merely removing the retaining screw 90, retaining shield 20 and cover plate 18 and exchanging the cylinder 14 which contains one interchangeable lock core 16 with another cylinder containing a different interchangeable lock core.

While various forms and modifications have been described above and illustrated in the drawings, it will be appreciated that the invention is not limited thereto but encompasses all variations within the scope of the following claims.

I claim the following:

1. A high security lock apparatus comprising:

(a) a lock cylinder, including an interchangeable lock core having first and second lobes;

(b) a lock housing defining a key receiving surface, said lock housing having cavity walls defined by first and second intersecting cavities which are generally cylindrical and extend approximately the length of said lock housing for receiving said first and second lobes of said lock cylinder;

(c) a cover plate having an opening through which a key may pass;

(d) a cover plate receiving recess which is formed by a generally U-shaped groove aligned parallel and adjacent to said key receiving surface within said first cavity, and which slidably receives said cover plate, wherein said cover plate covers a portion of said interchangeable lock core;

(d) a retaining shield received by said second cavity, said retaining shield including a post portion having first and second ends and a shield cover portion attached to said first end of said post and which partly covers said cover plate, said post portion having a flat abutment surface which abuts an end of said cover plate and thereby prevents said cover plate from being slidably removed from said U-shaped recess and a cut away portion defining a slot for receiving one of said lobes of said cylinder and thereby preventing movement of said cylinder within said cavity;

(e) said second post end has a threaded retaining hole; and (f) a U-shaped shackle, the U-shaped shackle having first and second shackle legs, said first and second shackle legs being formed to be received in said first and second shackle bores, respectively, wherein said second shackle cylinder bottom has formed therein a clearance hole, said clearance hole being aligned with said threaded retaining hole; and (g) a retaining screw, said retaining screw capable of being driven through said clearance hole into said threaded retaining hole to retain said retaining shield in a fixed position.

2. The apparatus of claim 1, wherein said lock housing is formed from steel.

3. The apparatus of claim 1, wherein said lock cylinder engages with said retaining shield.

4. The apparatus of claim 1, wherein said shield cover is flush with said key receiving surface.

5. The apparatus of claim 1, wherein said shield cover recess is aligned contiguous with said first cavity opening for allowing rotation of a key in said keyway.

6. The apparatus of claim 1, wherein said cover plate consists of hardened steel.

7. The apparatus of claim 1, wherein said cover plate includes at least one prong which extends into said cover plate opening, said prong covering a portion of said interchangeable lock core.

8. The apparatus of claim 1, wherein said cover plate includes first and second opposing prongs, said first and second opposing prongs being formed to cover a portion of said interchangeable lock core, said first and second prongs being positioned to inhibit rotation of said interchangeable lock core more than 90 degrees.

9. A high security lock apparatus comprising:

(a) a lock cylinder including an interchangeable lock core having first and second lobes;

(b) a lock housing defining a key receiving surface, said lock housing having cavity walls defined by first and second intersecting cavities which are generally cylindrical and extend approximately the length of said lock housing for receiving said first and second lobes of said lock cylinder, (c) a cover plate receiving recess which is formed by a groove having a depth of approximately one quarter of an inch, which is aligned parallel to said key receiving surface within said first cavity and discontinuing where said first and second cavities intersect, wherein said cover plate receiving recess is located approximately three sixteenths of an inch from said key receiving surface;

(d) a hardened steel cover plate having at least one rounded edge to conform to said cover plate receiving recess and having a cover plate opening through which a key may pass, said cover plate opening having at least one cover plate prong which extends into said cover plate opening and which is profiled to limit the amount of rotation of said key and to cover a portion of said interchangeable lock core and wherein said second cavity is slightly larger than said cover plate;

(e) a retaining shield received by said second cavity having a post having first and second post ends and a shield cover which is attached at said first post end, wherein said second post end has a threaded retaining hole, and wherein said post forms a groove perpendicular to said shield cover for receiving said second lobe of said lock cylinder;

(f) a U-shaped shackle, the U-shaped shackle having first and second shackle legs, said first and second shackle legs being formed to be received in said first and second shackle bores, respectively, wherein said second shackle cylinder bottom has formed therein a clearance hole, the clearance hole being aligned with said threaded retaining hole; and (g) a retaining screw, said retaining screw capable of being driven through said clearance hole into said threaded retaining hole to retain said retaining shield in a fixed position, wherein said retaining screw is at least 0.75" from said shield cover.

10. The apparatus of claim 1, wherein said retaining shield has a groove in said retaining shield post which is perpendicular to said shield cover and said groove mates with said second lobe of said lock cylinder so that said lock cylinder is retained in one position when said interchangeable core is rotated.

11. A high security lock apparatus comprising:

(a) a lock cylinder including an interchangeable lock core having first and second lobes;

(b) a lock housing defining a key receiving surface, said lock housing having cavity walls defined by first and second intersecting cavities which are generally cylindrical and extend approximately the length of said lock housing for receiving said first and second lobes of said lock cylinder, (c) a cover plate receiving recess which is formed by a groove, which is aligned parallel to said key receiving surface within said first cavity and discontinuing where said first and second cavities intersect, wherein said cover plate receiving recess is spaced apart from said key receiving surface;

(d) a hardened steel cover plate having at least one rounded edge to conform to said cover plate receiving recess and having a cover plate opening through which a key may pass, said cover plate opening having at least one cover plate prong which extends into said cover plate opening and which is profiled to limit the amount of rotation of said key and to cover a portion of said interchangeable lock core and wherein said second cavity is slightly larger than said cover plate;

(e) a retaining shield received by said second cavity having a post having first and second post ends and a shield cover which is attached at said first post end, wherein said second post end has a threaded retaining hole, and wherein said post forms a groove perpendicular to said shield cover for receiving said second lobe of said lock cylinder;

(f) a U-shaped shackle, the U-shaped shackle having first and second shackle legs, said first and second shackle legs being formed to be received in said first and second shackle bores, respectively, wherein said second shackle cylinder bottom has formed therein a clearance hole, the clearance hole being aligned with said threaded retaining hole; and (g) a retaining screw, said retaining screw capable of being driven through said clearance hole into said threaded retaining hole to retain said retaining shield in a fixed position.

12. The apparatus of claim 10, wherein said retaining shield has a groove in said retaining shield post which is perpendicular to said shield cover and said groove mates with said second lobe of said lock cylinder so that said lock cylinder is retained in one position when said interchangeable core is rotated.

* * * * *